US010669651B2

(12) United States Patent
Gupta

(10) Patent No.: US 10,669,651 B2
(45) Date of Patent: Jun. 2, 2020

(54) WOVEN FABRIC WITH IMPROVED COMFORT

(71) Applicant: Trident Limited, Sanghera (IN)

(72) Inventor: Abhishek Gupta, Sanghera (IN)

(73) Assignee: Trident Limited (IN)

( * ) Notice: Subject to any disclaimer, the term of this patent is extended or adjusted under 35 U.S.C. 154(b) by 44 days.

(21) Appl. No.: 16/148,469

(22) Filed: Oct. 1, 2018

(65) Prior Publication Data

US 2020/0056309 A1 Feb. 20, 2020

(30) Foreign Application Priority Data

Jul. 12, 2018 (IN) ..... 201811026095

(51) Int. Cl.
*D03D 15/00* (2006.01)
*D06C 3/00* (2006.01)
*D03D 1/00* (2006.01)

(52) U.S. Cl.
CPC ..... *D03D 15/00* (2013.01); *D06C 3/00* (2013.01); *D10B 2201/02* (2013.01); *D10B 2201/24* (2013.01); *D10B 2331/04* (2013.01)

(58) Field of Classification Search
CPC ..... D10B 2331/04; D10B 2201/02; D10B 2503/06; D10B 2201/24; D10B 2201/20; D10B 2503/062; D03D 15/00; D03D 13/008; D03D 15/0027; D03D 1/00; D03D 13/004; D03D 1/0017; D03D 27/08; D03D 47/3046; D03D 13/00; D03D 15/0094; A47G 9/0238; A47G 9/0246; A47G 9/02
See application file for complete search history.

(56) References Cited

U.S. PATENT DOCUMENTS 4,191,221 A * 3/1980 Boyer ..... D02G 3/36 139/426 R
4,352,380 A * 10/1982 Owen ..... D02G 3/36 139/416
4,425,398 A * 1/1984 Berczi ..... B41N 10/04 428/909
4,578,306 A * 3/1986 Heiman ..... D02G 3/04 442/214
4,670,326 A * 6/1987 Heiman ..... D03D 15/00 139/420 A
4,896,406 A * 1/1990 Weingarten ..... D02G 3/367 28/166
5,487,936 A * 1/1996 Collier ..... D03D 15/00 428/903
5,495,874 A * 3/1996 Heiman ..... D03D 15/00 139/420 A
7,549,281 B2 * 6/2009 Kuwano ..... D01F 2/06 57/243
7,572,744 B1 * 8/2009 Ikenaga ..... D03D 15/08 442/182
7,726,348 B2 * 6/2010 Heiman ..... D03D 15/00 139/383 R
8,186,390 B2 * 5/2012 Krishnaswamy ..... B32B 5/024 139/420 A
8,555,472 B2 * 10/2013 Cavallaro ..... D03D 1/0052 139/408
8,877,109 B1 * 11/2014 Cavallaro ..... D03D 1/0052 139/420 R
9,474,395 B2 * 10/2016 Garg ..... D03D 1/0017
9,534,323 B1 * 1/2017 Dubey ..... D03D 27/08
9,708,736 B2 * 7/2017 Agarwal ..... D02G 1/161
9,708,737 B2 * 7/2017 Agarwal ..... A47G 9/0238
9,777,411 B2 * 10/2017 Agarwal ..... D03D 1/007
9,970,133 B2 * 5/2018 Ukuma ..... D03D 13/008
10,066,324 B2 * 9/2018 Agarwal ..... D03D 13/008
10,240,283 B2 * 3/2019 Gupta ..... D06C 17/00
10,428,445 B2 * 10/2019 Agarwal ..... D02G 1/161
10,443,159 B2 * 10/2019 Agarwal ..... D03D 13/004
10,472,744 B2 * 11/2019 Agarwal ..... D03D 47/3046
2006/0179810 A1 * 8/2006 Liao ..... D01F 8/14 57/200
2007/0031664 A1 * 2/2007 Kuwano ..... D01F 2/06 428/364
2011/0070791 A1 * 3/2011 Kulkarni ..... D04H 13/00 442/35
2011/0223398 A1 * 9/2011 Dobin ..... D03D 15/00 428/196
2013/0177753 A1 * 7/2013 Ukuma ..... D03D 13/008 428/219
2015/0292125 A1 * 10/2015 Yoshida ..... D02G 3/26 139/420 R
2017/0088986 A1 * 3/2017 Gupta ..... D03D 27/08
2017/0145610 A1 * 5/2017 Kulkarni ..... D04H 13/00
2018/0080151 A1 * 3/2018 Goenka ..... D03D 15/0077
2019/0015192 A1 * 1/2019 Nakazawa ..... D01D 5/088

FOREIGN PATENT DOCUMENTS

CN 102312306 A 1/2012
CN 102433642 A 5/2012

(Continued)

*Primary Examiner* — Robert H Muromoto, Jr.
(74) *Attorney, Agent, or Firm* — Lerner, David, Littenberg, Krumholz & Mentlik, LLP

(57) ABSTRACT

A woven fabric having a novel composition of multiple fibres with improved comfort and performance is disclosed. Further, a fabric composition, construction and crimp control process provides enhanced comfort and performance by improving parameters such as thermal conductivity and moisture regulation along with other parameters such as dimensional stability, smoothness, drying properties and tensile strength. The woven fabric includes a plurality of warp yarns and a plurality of weft yarns interwoven with said plurality of warp yarns, where the plurality of warp yarns is a blended spun yarn including cotton fibre and regenerated cellulose fibre. Each of the plurality of weft yarns is a continuous polyester filament of fine count. The woven fabric composition includes more than 50% cotton, 15-25% regenerated cellulose fibre and less than 35% polyester, further wherein moisture regain of the woven fabric is in the range of 5.5%-8.5%.

24 Claims, No Drawings

(56) References Cited

FOREIGN PATENT DOCUMENTS

| | | | |
|---|---|---|---|
| CN | 103361818 | A | 10/2013 |
| CN | 105568490 | A | 5/2016 |
| CN | 107201590 | A | 9/2017 |
| EP | 2382344 | A2 | 11/2011 |
| EP | 3296437 | A2 | 3/2018 |
| WO | 2010071910 | A2 | 7/2010 |

* cited by examiner

WOVEN FABRIC WITH IMPROVED COMFORT

FIELD OF THE INVENTION

The present invention relates, generally, to woven fabrics, and more particularly to sheeting fabrics exhibiting improved comfort.

BACKGROUND OF THE INVENTION

Sheeting fabrics are formed primarily from cotton fibres or a blend of cotton and synthetic fibres such as polyester. Comfort is one of the most sought after properties of sheeting fabrics. It has been observed that sheeting fabrics formed primarily from cotton fibre provide comfort, however, said fabrics lack parameters such as dimensional stability, and wrinkle-resistance. Further, sheeting fabrics that comprise cotton and polyester fibres may have wrinkle resistance and dimensional stability due to presence of the polyester fibres in the fabric structure, however, it has relatively less moisture regain and thermal conductivity, thereby causing discomfort. Further, sheeting fabrics that comprise cotton and polyester fibres lack comfort due to deficit of parameters such as smoothness, shine and lustre.

In light of the aforementioned drawbacks, there is a need for a fabric which provides enhanced comfort by optimizing moisture and thermal conductivity. There is a need for a fabric which is economical, durable and comfortable. Further, there is a need for a fabric which exhibits enhanced smoothness, dimensional stability and microbe resistance properties. Furthermore, there is a need for a fabric which provides easy care properties, softness and drape with a comfort of cotton. Yet further, there is a need for a fabric, such that the fabric quality does not deteriorate after several washes and can sustain vibrant colours.

SUMMARY OF THE INVENTION

In various embodiments of the present invention, a woven fabric with improved comfort is provided. The woven fabric comprises a plurality of warp yarns interwoven with a plurality of weft yarns such that warp crimp is higher than weft crimp and warp cover factor is higher than weft cover factor. Further, each of the plurality of warp yarns is a blended spun yarn comprising cotton fibre and regenerated cellulose fibre and each of the plurality of weft yarns is a polyester filament. The woven fabric composition comprises more than 50% cotton, 15-25% regenerated cellulose fibre and less than 35% polyester, further wherein moisture regain of the woven fabric is in the range of 5.5%-8.5%.

In various embodiments of the present invention, a process for manufacturing an improved woven fabric is provided. The process comprises preparing a plurality of warp yarns comprising cotton fibre and regenerated cellulose fibre. The warp yarn is prepared by spinning the cotton fibre and regenerated fibre in a weight ratio of 70-75% cotton and 25-30% regenerated cellulose fibre. The process further comprises preparing a fabric by interweaving the plurality of warp yarns with a plurality of weft yarns, where each of the plurality of weft yarns is a polyester filament, such that warp crimp is higher than weft crimp and warp cover factor is higher than weft cover factor. Further, the process comprises processing, dyeing and finishing the fabric. Finishing of fabric includes drying the fabric, sanforizing by overfeeding in warp direction and providing a high stretch in weft direction. The woven fabric composition comprises 50-60% cotton, 15-25% regenerated cellulose fibre and 25-35% polyester.

DETAILED DESCRIPTION OF THE INVENTION

The present invention provides a woven fabric comprising a novel composition of multiple fibres with improved comfort and performance. Further, the present invention provides for a fabric composition, construction and crimp control process which affords enhanced comfort and performance by improving parameters such as thermal conductivity and moisture regulation. In accordance with various embodiments of the present invention, the woven fabric comprises a plurality of warp yarns and a plurality of weft yarns interwoven with said plurality of warp yarns. Each of the plurality of warp yarns is a blended spun yarn including cotton fibre and regenerated cellulose fibre. Each of the plurality of weft yarns is a continuous polyester filament of fine count and thereby has a high surface area. The warp yarns comprising cotton and regenerated cellulose fibre are placed on top and the weft polyester filaments are used as a base during weaving to improve drying properties. Additionally, the fabric is configured such that cover factor of the warp yarns is higher than cover factor of the weft yarns to aid quick drying properties. In accordance with an embodiment of the present invention, the count of the cotton fibres, regenerated cellulose fibres and polyester filament is selected such that the woven fabric composition comprises 50-60% cotton, 15-25% regenerated cellulose fibre and 25-35% polyester. The novel composition and construction of the fabric provides comfort of cotton by improving moisture regulation and thermal conductivity along with other parameters such as dimensional stability, smoothness, drying properties and tensile strength.

Exemplary embodiments herein are provided only for illustrative purposes and various modifications will be readily apparent to persons skilled in the art. The general principles defined herein may be applied to other embodiments and applications without departing from the spirit and scope of the invention. The terminology and phraseology used herein is for the purpose of describing exemplary embodiments and should not be considered limiting. Thus, the present invention is to be accorded the widest scope encompassing numerous alternatives, modifications and equivalents consistent with the principles and features disclosed herein. For purposes of clarity, details relating to technical material that is known in the technical fields related to the invention have been briefly described or omitted so as not to unnecessarily obscure the present invention.

It is to be noted that, as used in the specification by the term "substantially" it is meant that the recited characteristic, parameter, or value need not be achieved exactly, but that deviations or variations, including for example, tolerances, measurement error, measurement accuracy limitations and other factors known to those skilled in the art, may occur in amounts that do not preclude the effect the characteristic was intended to provide.

The present invention would now be discussed in context of following embodiments.

In accordance with an embodiment of the present invention, the woven fabric comprises a plurality of warp yarns and a plurality of weft yarns interwoven with said plurality of warp yarns. The plurality of warp yarns and the plurality of weft yarns are interwoven using one or more weaving patterns to achieve a cotton rich fabric with thread count in the range of 300-1500. The weaving patterns may include, but are not limited to dobby, Jacquard, normal satin, percale, twill, basket, oxford, stripe, etc. In a preferred embodiment of the present invention, the weaving pattern is satin weave.

In accordance with an embodiment of the present invention, each of the plurality of warp yarns is a blended spun yarn including cotton fibre and regenerated cellulose fibre. In an exemplary embodiment of the present invention, the regenerated cellulose fibre may be Lyocell. In accordance with an embodiment of the present invention, the blended warp yarn comprises 70-75% by weight of cotton fibres and 25-30% by weight of Lyocell fibres. The blended warp yarn has a count ranging from 40 Ne to 60 Ne. In a preferred embodiment of the present invention, the blended warp yarn has a count of 55 Ne. Each of the plurality of weft yarns is a continuous polyester filament. The linear mass density of the polyester filament is in the range 10 to 50 D (Denier). The use of continuous polyester filament instead of a spun polyester yarn provides better air flow and reduces hairiness. Additionally, the use of fine continuous polyester filament aids in achieving the novel composition of the present invention.

In accordance with an embodiment of the present invention, process parameters are modified to generate more crimp in warp yarn to accommodate higher percentage of cotton and Lyocell. In an embodiment of the present invention, the process parameters may include, but are not limited to weft insertion with minimum pick length during picking, and overfeeding in warp direction and high stretching in weft direction during finishing. In particular, construction and wet processes are configured to minimise crimp in weft and maximise crimp in warp. In an exemplary embodiment of the present invention, insertion of 4 picks in a shed facilitates warp crimp of 7.5% and weft crimp of 3.5%. Further, insertion of 3 picks in the shed may facilitate a warp crimp of 6.5% and a weft crimp of 3.5%. A warp crimp of 6.5% and a weft crimp of 3.5% may be achieved for the fabric of the present invention in comparison to a warp crimp of 5% and a weft crimp of 4.5% for 100% cotton fabric.

The warp yarns comprising cotton and Lyocell, are placed on top and the weft polyester filaments are used as a base during weaving such that only cotton and Lyocell blended yarns come in contact with human skin when touched. Further, as explained later in the specification, high warp cover factor also facilitates that the cotton and Lyocell blended yarns come in contact with human skin when touched. Additionally, in accordance with an embodiment of the present invention, ends per inch (e.p.i) and picks per inch (p.p.i) are selected such that cover factor of warp yarn is higher than weft yarn to accommodate higher percentage of cotton in the fabric. Higher warp threads per inch than weft threads provide higher warp cover factor. Higher warp cover factor prevents the polyester fibres in the fabric from extending to the top surface. In an exemplary embodiment of the present invention, the e.p.i is 205 and p.p.i is 99/3'. In an embodiment of the present invention, the warp cover factor is greater than 22. In an exemplary embodiment of the present invention, the warp cover factor is 28.3 and weft cover factor is 13.

Further, the weaving configuration comprising warp on top and weft at the base enhances the performance of the fabric when used for fabrication of bedsheet. In accordance with an embodiment of the present invention, in operation, the moisture absorbent portion (hygroscopic) of the bedsheet comprising cotton and Lyocell will be on the top and the polyester portion (hydrophobic) will be at the base, thereby improving comfort. In various embodiments of the present invention, fabric composition, construction balance and crimp control improves surface moisture, thereby enhancing comfort when used for the fabrication of bedsheets.

In another embodiment of the present invention, surface of warp yarns is raised and air pockets are increased to improve softness and to enhance thermal resistance without using wool fibre. The surface of warp yarns may be raised by brushing or peaching.

In a preferred embodiment of the present invention, the woven fabric comprises blended warp yarn having a count of 55Ne, where the weight of cotton fibre to Lyocell fibre is 75:25. Further the woven fabric comprises continuous polyester filament having a linear density of 30 D such that the woven fabric composition comprises 50-60% cotton, 15-25% Lyocell and 25-35% polyester. In another preferred embodiment of the present, invention the fabric composition includes substantially 52% cotton, 17% Lyocell and 31% polyester.

As shown in Table 1 and Table 2 below, novel composition of the fabric in accordance with various embodiments of the present invention, illustrates a balance of the performance parameters at low cost. The fabric provides comfort, smoothness and moisture regain properties of cotton along with improved tensile strength and dimensional stability. Referring to Table 1, a comparison between the fabric composition [55(Cotton:Lyocell-70:30)*30D] of the present invention and fabrics comprising 100% cotton and fabrics comprising cotton and polyester is illustrated. Referring to Table 2, a comparison between the fabric composition of the present invention (Case 3 and Case 4) and fabrics comprising cotton and polyester (Case 1) and fabrics comprising Lyocell and polyester (Case 2) is illustrated.

TABLE 1

Constructional Properties of RNS Sheets

| Sr. No. | Physical Properties | | UOM | Test Method | 500 TC RNS 55[Cot:Tencel-70:30] × 30D, 196 × 99/3 Normal Soft | 500 TC (100% Cotton) 100 × 100, 224 × 86/3 Normal Soft | 500 TC (100% Cotton) 80 × 100, 174 × 78/4 Wrinkle Free | 500 TC (Cotton:Poly) 60 × 30D, 164 × 81/4 Normal Soft |
|---|---|---|---|---|---|---|---|---|
| 1 | Tensile | Warp | lbf | ATSM | 89.2 | 65.12 | 37.5 | 71.1 |
| | | Weft | lbf | D5034 | 120.2 | 55.44 | 35.2 | 44.2 |
| 2 | Tear | Warp | lbf | ATSM | 6.89 | 5.94 | 2.41 | 9.57 |
| | | Weft | lbf | D1424 | 9.57 | 8.89 | 3.64 | 9.4 |
| 3 | Seam | Warp | lbf | ATSM | 49.7 | 38.9 | 20.6 | 19.5 |
| | Strength | Weft | lbf | D1683 | 68.7 | 41.58 | 21.6 | 47.5 |

TABLE 1-continued

| Constructional Properties of RNS Sheets | | | | | | | |
|---|---|---|---|---|---|---|---|
| Sr. No. | Physical Properties | UOM | Test Method | 500 TC RNS 55[Cot:Tencel-70:30] × 30D, 196 × 99/3 Normal Soft | 500 TC (100% Cotton) 100 × 100, 224 × 86/3 Normal Soft | 500 TC (100% Cotton) 80 × 100, 174 × 78/4 Wrinkle Free | 500 TC (Cotton:Poly) 60 × 30D, 164 × 81/4 Normal Soft |
| 4 | Smoothness Appearance rating | | AATCC 124@5HL | 2.5 | 1.5 | 3 | 2 |

TABLE 2

| | Case1 (Cotton Polyester) | | | | | | | | |
|---|---|---|---|---|---|---|---|---|---|
| | Standard Moisture | | | case2 (Lyocell Polyester) | | case3 ( Low Polyester %) | | case4 (low polyester %) | |
| | Regain of fibre | % Component | Fabric MR | % Component | Fabric MR | % Component | Fabric MR | % Component | Fabric MR |
| cotton | 8 | 50 | | 0 | 0 | 50 | 4 | 55 | 4.4 |
| Lyocell | 11.5 | 0 | | 70 | 8.05 | 20 | 2.3 | 20 | 2.3 |
| Polyester | 0.4 | 50 | | 30 | 0.12 | 30 | 0.12 | 25 | 0.1 |
| | | 100 | 4.2 | 100 | 8.17 | 100 | 6.42 | 100 | 6.8 |

In a preferred embodiment of the present invention, the fabric composition comprising 52% cotton, 17% Lyocell and 31% polyester provides a moisture regain of 6.46%. Additionally, electric conductivity is directly related to moisture content as well as ionic character of the fabric. Therefore, the fabric has more static electricity dissipation leading to high comfort during movement of a human body on the fabric surface.

As illustrated in Table 1 and 2, advantageously, in accordance with various embodiments of the present invention, the woven fabric provides a balance of the performance parameters at a lower cost. The performance parameters may include but are not limited to smoothness, shine, wrinkle-resistance, lustre, drying properties, colour retention, dimensional stability. In particular, the novel fabric composition facilitates the fabric to exhibit the properties of cotton, Lyocell and polyester, respectively, and also provide a balance of the performance parameters. In particular, Lyocell fibres in the fabric absorbs moisture and prevents bacterial growth leading to better hygiene. Further, Lyocell blended with cotton provides a dry feel to human skin and provides better moisture transportation compared to 100% Cotton. Furthermore, the blend of Lyocell with cotton provides better stability during weaving as compared to 100% Lyocell. The blend of Lyocell with cotton provides smooth appearance and soft feel with no wrinkles as compared to fabrics with 100% Cotton. Furthermore, the weft polyester filament provides the fabric a dry feel, quick moisture evaporation, enhances drying properties and provides dimensional stability.

In accordance with an embodiment of the present invention, the process of manufacturing the woven fabric includes spinning, weaving and processing. The process of spinning includes blending cotton staple fibres with Lyocell fibres in a weight ratio including 70-75% of cotton fibres to 25-30% of Lyocell fibres to produce a plurality of blended warp yarns having a count ranging from 40 Ne to 60 Ne. In an exemplary embodiment of the present invention, the spinning may be carried out in a draw frame. The process of weaving includes, interweaving the produced plurality of warp yarns with a plurality of weft yarns using one or more weaving patterns to achieve a cotton rich fabric with a thread count in the range of 300-1500. Further, the weaving process includes using the plurality of weft yarns as a base such that the plurality of warp yarns forms the top of the fabric. In accordance with an embodiment of the present invention, each of the plurality of weft yarns is a continuous polyester filament. The linear mass density of the polyester filament is in the range 10 to 50 D (Denier). The use of continuous polyester filament instead of spun polyester reduces cost and enables the use of a lower count of polyester to achieve the novel composition of the present invention. The weaving patterns may include, but are not limited to dobby, jacquard, normal satin, percale, twill, basket, oxford, stripe, etc. In an exemplary embodiment of the present invention, a plurality of blended warp yarns having count of 55Ne, where the weight of cotton fibre to Lyocell fibre is 75:25 are interwoven with a plurality continuous polyester weft filaments having a linear density of 30 D. Further, the woven fabric is processed, where the processing includes singeing, de-sizing, scouring, bleaching, heat-setting. Finally, the woven fabric is dyed and finished. In an exemplary embodiment of the present invention, the woven fabric is dyed using a pad dyeing process. In an exemplary embodiment of the present invention, finishing includes drying the fabric on stenter and sanforizing by overfeeding in warp direction and providing a high stretch in weft direction. The woven fabric composition comprises 50-60% cotton, 15-25% Lyocell and 25-35% polyester. In another exemplary embodiment of the present, invention the fabric composition includes 52% cotton, 17% Lyocell and 31% polyester.

While the exemplary embodiments of the present invention are described and illustrated herein, it will be appreciated that they are merely illustrative. It will be understood by those skilled in the art that various modifications in form and detail may be made therein without departing from or offending the spirit and scope of the invention.

The invention claimed is:

1. A woven fabric with improved comfort comprising a plurality of warp yarns interwoven with a plurality of weft yarns such that warp crimp is higher than weft crimp and warp cover factor is higher than weft cover factor, wherein each of the plurality of warp yarns is a blended spun yarn comprising cotton fibre and regenerated cellulose fibre and each of the plurality of weft yarns is a polyester filament, wherein the woven fabric composition comprises more than 50% cotton, 15-25% regenerated cellulose fibre and less than 35% polyester, further wherein moisture regain of the woven fabric is in the range of 5.5%-8.5%.

2. The woven fabric as claimed in claim 1, wherein the woven fabric composition comprises 52% cotton, 17% regenerated cellulose fibre and 31% polyester.

3. The woven fabric as claimed in claim 1, wherein the regenerated cellulose fibre is Lyocell.

4. The woven fabric as claimed in claim 1, wherein the blended warp yarn comprises 70-75% by weight of cotton fibres and 25-30% by weight of regenerated cellulose fibre.

5. The woven fabric as claimed in claim 2, wherein the blended warp yarn comprises 75% by weight of cotton fibres and 25% by weight of regenerated cellulose fibre.

6. The woven fabric as claimed in claim 1, wherein the blended warp yarn has a count ranging from 40 Ne to 60 Ne.

7. The woven fabric as claimed in claim 2, wherein the blended warp yarn has a count of 55 Ne.

8. The woven fabric as claimed in claim 1, wherein the linear mass density of the polyester filament is in the range 10 D to 50 D (Denier).

9. The woven fabric as claimed in claim 8, wherein the linear mass density of the polyester filament is 30 D (Denier).

10. The woven fabric as claimed in claim 1, wherein the ends per inch (e.p.i) are in the range of 200-220 and picks per inch (p.p.i) are in the range of 90/3'-100/3' such that a warp cover factor is higher than a weft cover factor.

11. The woven fabric as claimed in claim 10, wherein the cover factor of warp yarn is more than 22.

12. The woven fabric as claimed in claim 10, wherein the cover factor of warp yarn is 28.3 and cover factor of weft yarn is 13.

13. The woven fabric as claimed in claim 1, wherein thread count of the fabric is in the range of 300-1500.

14. The woven fabric as claimed in claim 1, wherein weaving patterns for the woven fabric are selected from a group comprising of dobby, jacquard, normal satin, percale, twill, basket, oxford, and stripe.

15. The woven fabric as claimed in claim 1, wherein a warp crimp is 6.5% and a weft crimp is 3.5%.

16. The woven fabric as claim in claim 1, wherein the moisture regain of the fabric is 6.46%.

17. A process for manufacturing an improved woven fabric, said process comprising:

preparing a plurality of warp yarns comprising cotton fibre and regenerated cellulose fibre, wherein the warp yarn is prepared by spinning the cotton fibre and regenerated fibre in a weight ratio of 70-75% cotton and 25-30% regenerated cellulose fibre;

preparing a fabric by interweaving the plurality of warp yarns with a plurality of weft yarns, such that warp crimp is higher than weft crimp and warp cover factor is higher than weft cover factor, wherein each of the plurality of weft yarns is a polyester filament; and processing, dyeing and finishing the fabric, wherein finishing includes drying the fabric, sanforizing by overfeeding in warp direction and providing a high stretch in weft direction, wherein the woven fabric composition comprises 50-60% cotton, 15-25% regenerated cellulose fibre and 25-35% polyester.

18. The process as claimed in claim 17, wherein linear mass density of polyester filament is in the range 10 to 50 D (Denier).

19. The process as claimed in claim 17, wherein the regenerated cellulose fibre is Lyocell.

20. The process as claimed in claim 17, wherein the blended warp yarn has a count ranging from 40 Ne to 60 Ne.

21. The process as claimed in claim 17, wherein the blended warp yarn has a count of 55 Ne.

22. The process as claimed in claim 17, wherein the linear mass density of the polyester filament is 30 D (Denier).

23. The process as claimed in claim 17, wherein preparing the woven fabric includes raising a surface of each of the plurality of warp yarns and increasing air pockets to improve softness and enhance thermal resistance.

24. The process as claimed in claim 17, wherein the weaving patterns are selected from a group comprising of dobby, jacquard, normal satin, percale, twill, basket, oxford, and stripe.

* * * * *